United States Patent [19]

Masuda et al.

[11] Patent Number: 4,985,720

[45] Date of Patent: Jan. 15, 1991

[54] METHOD OF CONTROLLING TEMPERATURE FOR DRYING PHOTOSENSITIVE MATERIAL

[75] Inventors: Yoshihiro Masuda; Takashi Yagi; Eiji Nishimura, all of Kyoto, Japan

[73] Assignee: Dainippon Screen Mfg. Co., Ltd., Japan

[21] Appl. No.: 219,323

[22] Filed: Jul. 15, 1988

[30] Foreign Application Priority Data

Jul. 15, 1987 [JP] Japan ..... 62-174920

[51] Int. Cl.[5] ..... G03D 3/00; F26B 21/00

[52] U.S. Cl. ..... 354/299; 34/44; 34/155

[58] Field of Search ..... 354/299, 321, 322; 219/492, 494, 497; 34/44, 46, 48, 49, 155

[56] References Cited

U.S. PATENT DOCUMENTS

| | | | |
|---|---|---|---|
| 3,707,777 | 1/1973 | Geyken et al. | 34/48 |
| 4,160,153 | 7/1979 | Melander | 219/492 |
| 4,316,663 | 2/1982 | Fischer | 354/299 |
| 4,421,399 | 12/1983 | Steube | 354/299 |
| 4,439,931 | 4/1984 | Mizuta | 34/44 |
| 4,495,713 | 1/1985 | Williner | 34/48 |

*Primary Examiner*—A. A. Mathews

*Attorney, Agent, or Firm*—Ostrolenk, Faber, Gerb & Soffen

[57] ABSTRACT

The temperature within a drying section of a photosensitive material processing apparatus is controlled at a proper standby temperature when there is no photosensitive material within the apparatus. The standby temperature is estimated from temperature increase characteristics with reference to the operating temperature of the apparatus and/or the length of time required for photosensitve material to arrive at the drying section.

26 Claims, 5 Drawing Sheets

METHOD OF CONTROLLING TEMPERATURE FOR DRYING PHOTOSENSITIVE MATERIAL

BACKGROUND OF THE INVENTION (1) Field of the Invention

The present invention relates to an apparatus for processing photosensitive materials, such as an automatic film developing machine and a photosensitive printing plate processing apparatus. More particularly, the invention relates to a method of controlling a temperature within the drying section of such an apparatus. According to the invention, the drying section is maintained at a low temperature during a standby period (when photosensitive material is not present in the apparatus). To dry the photosensitive material, the temperature of the drying section is raised to a predetermined level. The invention achieves energy savings and reduces costs.

(2) Description of the Prior Art

FIG. 3 of the accompanying drawing schematically shows a photosensitive processing apparatus and, in particular, an automatic film developing machine.

This machine comprises a main frame 1 housing a developing tank 2, a fixing tank 3 and a rinsing tank 4 arranged in series. An exposed photographic film is transported by an unillustrated transport member along a path indicated by a chain dot line and arrows through the tanks for developing, fixing and rinsing. The main frame 1 further houses a drying section 5 disposed on the film path downstream of the tanks. The drying section 5 directs hot air heated by heaters 6 to the film to evaporate water and to dry the film. The dried film is delivered to a receptacle 7. A lid 8 including an exhaust duct 9 is mounted on top of the main frame 1.

The drying section 5 includes a drying temperature sensor, not shown, for communicating on actually measured drying temperature to a control section 11. The control section 11 carries out temperature control by turning the heaters 6 on and off in response to the actually measured drying temperature.

In recent years, measures for saving energy or resources have been taken with such an automatic film developing machine. These measures include (1) reducing the drive rate of the transport member and (2) stopping delivery of water to the rinsing tank 4 during a standby period when there is no film to be processed.

The drying section 5 includes powerful electric heaters and large blowers in order to dry the film reliably. The heaters and the blowers consume more electricity than any other part of the machine. Energy is saved by stopping these heaters and blowers. Thus, it has been conventional practice to operate the heaters at a low temperature or to stop the blowers during a standby period.

A unit for changing these devices from a standby state to an operative state comprises a film detector 10 such as a photoelectric switch, a microswitch or the like mounted at a film inlet of the developing machine. The film detector 10 detects a leading end of the entering film and outputs a detection signal which forms a basis for controlling the heaters and blowers.

Energy is effectively saved by maintaining the temperature in the drying section 5 at a preheating temperature during the standby period (hereinafter referred to as "standby temperature") which is lower than a predetermined operating temperature for actually drying the film. Conventionally, however, the standby temperature is simply set at a level which is lower than the operating temperature by a fixed amount. This practice has disadvantages 7 as described below.

When the heaters 6 are continuously electrified after the drying section 5 has been maintained at the standby temperature, the temperature of the drying section 5 does not instantly rise to the operating temperature. The temperature rises to the operating temperature gradually, describing a relatively gentle curve as shown in FIG. 2, for example.

On the other hand, the developing period for the film under treatment, namely the time required for the film to travel through the developing solution in the developing tank 2, is variable and depends on several factors such as the type of film, the type of processing solution, and the film exposing conditions. The film is transported at low speed to extend the developing period. The film is transported at high speed to shorten the developing period. Consequently, the time from the point of time at which the film is fed into the machine (and the heaters 6 begin to be electrified continuously in response to the signal of detector 10) until the point of time at which the film reaches the drying section 5 is variable.

The difference between the standby temperature and the operating temperature could be large if film is transported only at low speed. However, with a large difference, the drying section 5 can not be heated to the operating temperature in time to properly dry film transported at high speed. Thus, high speed film would be insufficiently dried. Conventionally, therefore, the standby temperature is set to a somewhat higher level so as to be suited for the situation in which film is transported at the highest speed and thus for the shortest developing time) possible for the machine. This practice unsatisfactorily wastes energy.

Further, when the standby temperature is set to a lower level than the operating temperature by a fixed amount, the time taken to reach the operating temperature depends on the operating temperature. That is, when the heaters 6 are continuously electrified, the temperature in the drying section 5 rises rapidly in the low temperature region and slowly in the high temperature region as seen in FIG. 2. Thus, the time required for the standby temperature to rise to the operating temperature depends on the level selected for the operating temperature.

SUMMARY OF THE INVENTION

The present invention is directed to a method of (and a system for) controlling the temperature of a drying section to reduce the total energy consumption thereof. The method includes the steps of: inputting a current operating mode of a machine for processing photosensitive material; drying photosensitive material in a drying section of the machine at an operating temperature; and, in response to the inputting step, maintaining the drying section at a standby temperature The standby temperature is functionally related to (a) the current operating mode of the machine and (b) the ability of the drying section to increase its temperature from the standby temperature to the operating temperature.

The present invention is also directed to a method of obtaining data for controlling the drying section. The method includes the steps of: performing preliminary experiments on a section for drying photosensitive material within a processing machine, the preliminary experiments including setting and operating the temperature of the drying section at increasingly higher levels; calculating the respective rates of temperature increase within the drying section between each of the levels' and multiplying each of the temperature increase rates by a period of time necessary to feed the photosensitive material through the processing machine.

The object of the present invention is to provide a method of controlling the temperature within a photosensitive material processing apparatus to eliminate the disadvantages of the prior art noted above.

According to the present invention, standby temperature data are obtained through preliminary experiments and the like and stored in a memory device. A standby temperature is established in response to various operating conditions of the processing machine. Such operating conditions include an operating temperature of the drying section and a developing period or transport speed of a film or other photosensitive material under treatment. In operating, when the operating temperature and the developing period are set, a corresponding temperature difference is outputted from the memory device and the heating section is set to a standby temperature obtained by deducting the temperature difference from the set operating temperature.

The standby temperature is thus maintained to a predetermined level below the set operating temperature in response to the set operating temperature and the developing period. This standby temperature is increased when film is fed into the processing machine. The drying section reaches the set operating temperature by the time the film arrives at the drying section (after passing through the developing, fixing and rinsing tanks). The film is thereby reliably dried. The present invention thus produces an excellent drying effect while achieving a significant improvement in energy savings.

Other features and advantages of the present invention will be apparent from the following description of preferred embodiments.

DETAILED DESCRIPTION OF THE PREFERRED EMBODIMENTS

Figure 1:
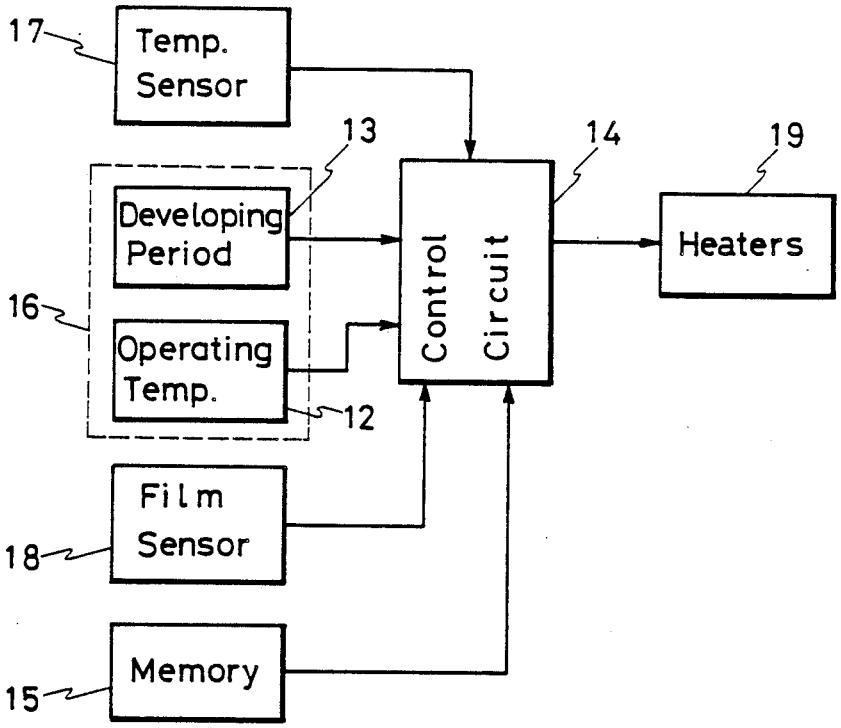
FIG. 1 is a block diagram illustrating an embodiment of the invention.

The automatic developing machine shown in FIG. 1 has an operating temperature setting unit 12 and a developing period setting unit 13 both included in a data input section 16.

The operating temperature setting unit 12 is used to set an operating temperature for the drying section 5. The developing period setting unit 12 is used to set an appropriate developing period correspond to the film to be developed. The film being processed is transported at such a speed that it passes through the developing solution in the developing tank 2 in a time equal to the selected developing period. The data set through these setting units 12 and 13 are communicated to a control circuit 14.

In response to the data, the control circuit 14 selects a temperature difference corresponding to the input operating temperature and developing period from data stored in a data memory 15.

Temperature difference data are obtained in advance through preliminary experiments and the like. The data represents temperature differences between operating temperatures and preheating or standby temperatures. The temperatures of drying section 5 is reduced to such standby temperatures to cope with various operating temperature and developing periods. An example of such data is set out in Table 1 below.

TABLE 1

Temperature Differences according to Operating Temperatures and Developing Periods

| Operating Temp. (°C.) | Developing Periods (sec.) 20–29 | 30–39 | 40 & above |
|---|---|---|---|
| 55 & above | 1 | 2 | 4 |
| 50–54.9 | 1 | 3 | 5 |
| 45–49.9 | 2 | 4 | 7 |
| 40–44.9 | 3 | 6 | 9 |
| Below 40 | 5 | 9 | 13 |

Assuming, for example, that the developing period is set to 27 seconds and the operating temperature to 52° C., the section of this table where the column corresponding to a 20–29 second developing period and the row of the 50–54.9° C. operating temperature meet shows numerical value "1". The "1" is deducted from the operating temperature 52° C. to arrive at a standby temperature of 51° C.

Figure 4:
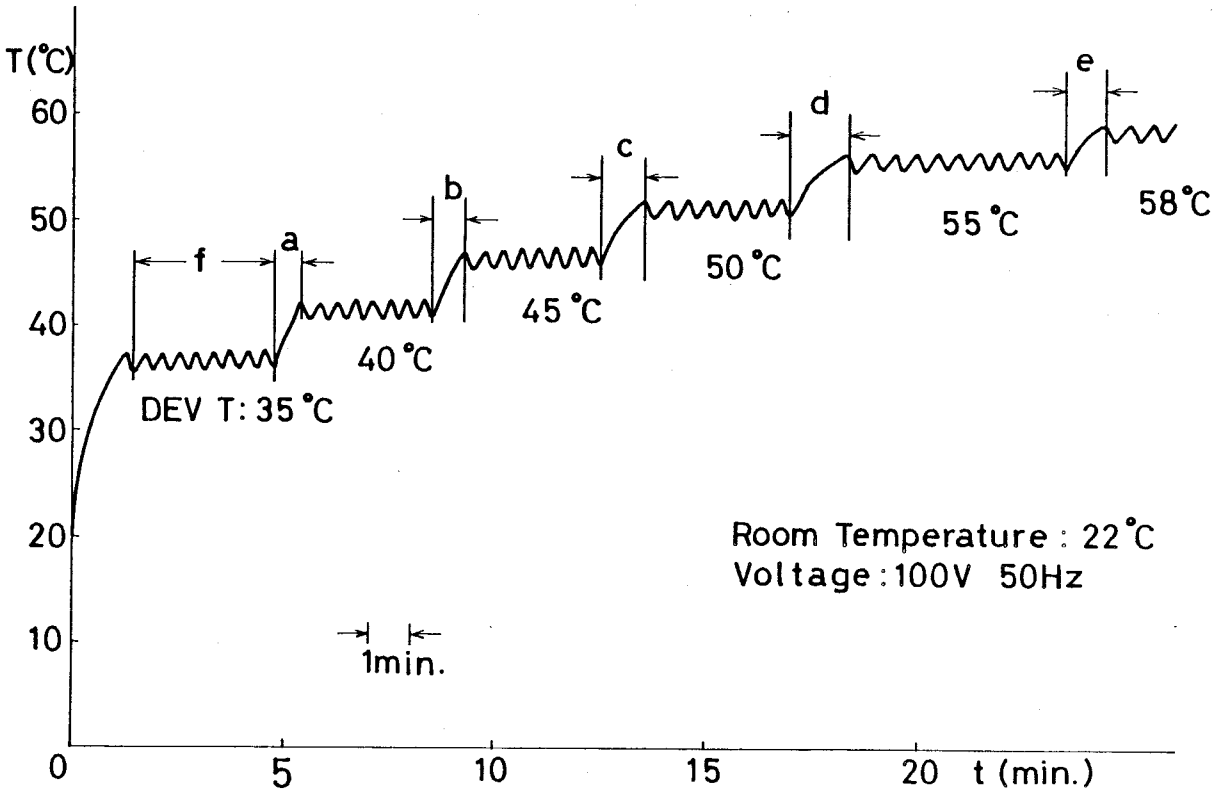
FIG. 4 is a graph showing a stepwise temperature rising mode for the drying section.

How the above temperature difference data are obtained will be described next. FIG. 4 is a graph showing a relationship between temperatures actually measured near the drying heaters and the lapse of time, with the operating temperature set to stepwise higher levels. In the experiment, the operating temperature was first set at 35° C. and the automatic developing machine was switched on. After the operating temperature was reached, an interval of about three minutes was provided as referenced at f in the graph and then the operating temperature was reset to 40° C. Thereafter, the set operating temperature was similarly raised 5° C. in succession except at the last step where it was raised 3° C. from 55° C. to 58° C. Areas a to e in the graph each indicate a period during which temperature rises from one set temperature to another. These areas provide temperature increase rates as set out in the table below. Since each area had a very limited range, the temperature increase rate within each area can be considered constant.

TABLE 2

| Areas | a | b | c | d | e |
|---|---|---|---|---|---|
| Temp. Increase Rates (°C./sec.) | 0.113 | 0.094 | 0.076 | 0.062 | 0.051 |

The temperature difference data are obtained by multiplying the temperature increase rates of Table 2 by a period of time from entry of the film into the automatic developing machine till arrival of the film at an inlet of the drying section (hereinafter referred to as entry to drying section period).

The entry to drying section period varies from machine to machine. The above was conducted with an automatic developing machine which carried out development, fixation and rinsing in an equal processing time ratio. Thus, the entry to drying section period was regarded as three times the developing period. The data for the column corresponding to a 20–29 second developing period, for example, were derived from the equation: 20 seconds X 3=60 seconds.

The graph of FIG. 4 is in a serrated form since the drying heaters were controlled by an ON-OFF power switching operation and this control was effected in the above experiment within the range of about 2° C. Therefore, the temperature difference data in Table 1 were obtained by deducting 2° C. and omitting decimal fractions to provide a factor of safety.

For example, the section of Table 1 within the column corresponding to a developing period equal to and above 40 seconds and the row corresponding to an operating temperature equal to or above 55° C. is derived as follows:

The temperature increase rate equals 0.051° C./sec. (from Table 2)

x (developing time which equals 40 sec.×3)−2° C.=4.12° C.=4° C.

The foregoing experiment is only an example and may be varied in many ways. To obtain the temperature data, the set operating temperature may be raised by a smaller amount and/or the interval f (FIG. 4) may be extended, for example. Such variations will produce somewhat different results. Further, the data are variable dependent upon the room temperature and other environmental factors. It is therefore desirable to take measurements under a plurality of different conditions and to employ the data suited to the specific environment encountered.

Another method of obtaining the data will be described next with reference to FIG. 2 which shows an increase in the operating temperature from 20° C. (room temperature) while the drying heaters are continuously electrified. In in this situation, temperature increase rates may be obtained for sections of 5° C., for example. The rates can be applied in the same calculation described above.

Figure 2:
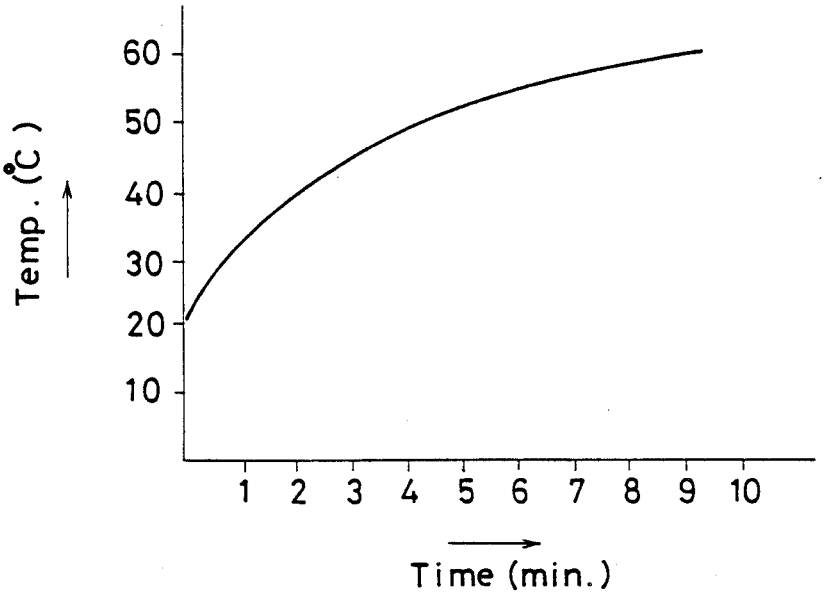
FIG. 2 is a graph showing temperature rise in a drying section.
Figure 3:
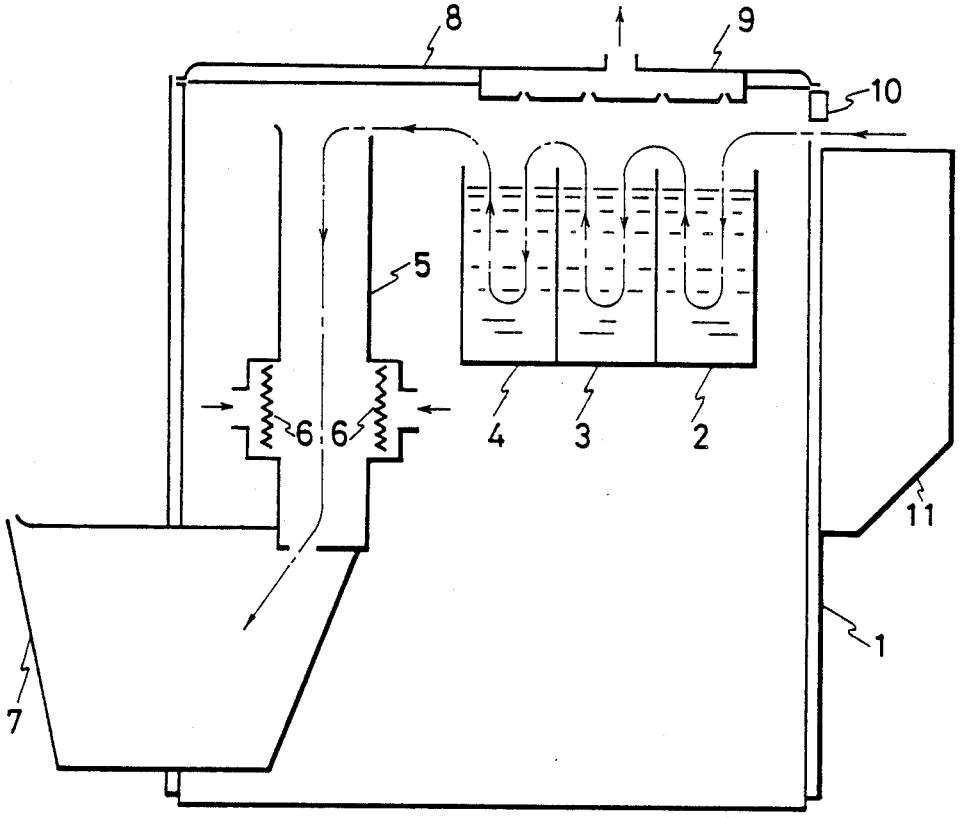
FIG. 3 is a schematic view of an automatic film developing machine with which the invention may be applicable.

The graph of FIG. 2 illustrates the situation where the heaters are switched on with the drying section at 20° C. or thermal equilibrium. Temperature increase will take a different form where the heaters are started at a different temperature. Consequently, the data do not always agree with the data obtained from FIG. 4.

Further, in the example shown in FIG. 2, the operating temperature is raised directly from the low level to the high level. This entails a considerable heat loss to the main machine frame and other components. The graph of FIG. 2 shows a smaller inclination (i.e. temperature increase rate) than the graph of FIG. 4 in which the temperature is raised stepwise with intervals between the temperature raising periods.

Next, Table 3 shows temperature difference data corresponding only to variations in the operating temperature, that is, temperature differences for allowing the temperature in the drying section 5 to rise to the operating temperature by the time the film reaches the drying section 5 with the developing period maintained constant.

TABLE 3

| Set Temperature Differences according to Operating Temperatures | |
|---|---|
| Operating Temp. (°C.) | Temp. Differences (Operating Temp.-Standby Temp.) |
| 55 & above | 1 |
| 50–54.9 | 1 |
| 45–49.9 | 2 |
| 40–44.9 | 3 |
| Below 40 | 5 |

The data in Table 3 correspond to the data in Table 1 with the developing period set at 20 seconds (representing the maximum film speed).

Table 4 below shows temperature difference data corresponding only to variations in the developing period, that is, temperature differences for allowing the standby temperature in the drying section 5 to be set in accordance with various periods of time from the film feed to the arrival of the film at the drying section 5, with the operating temperature maintained constant.

TABLE 4

| Set temperature Differences according to Developing Periods | |
|---|---|
| Developing Periods (sec.) | Temp. Differences (°C.) (Operating Temp.-Standby Temp.) |
| 20–29 | 1 |
| 30–39 | 2 |
| 40 & above | 4 |

The data in Table 4 correspond to the data in Table 1 with the operating temperature set at 55° C. or above.

These data are obtained through actual measurements taken with the automatic film developing machine for which the data are intended and are stored in the data memory.

In operation, an operating temperature and a developing period are set through the operating temperature setting unit 12 and the developing period setting unit 13 and are inputted to the control circuit 14. Then the control circuit 14 selects the temperature difference corresponding to the input data from the data stored in the data memory 15.

When the operating temperature is set at 45° C. and the developing period at 20 seconds, the corresponding temperature difference is "2° C." as seem from Table 1. The control circuit 14 reads this data from the data memory 15, and derives a standby temperature from an operation "operating temperature -temperature difference". In accordance with the standby temperature thus obtained, the drying section 5 is maintained at the corresponding temperature during a standby period.

In other words, an actual temperature of the drying section is measured by a temperature sensor 17 provided in the drying section, for comparison with the above standby temperature. This forms the basis for maintaining the heating section by switching drying heaters 19 on and off.

When an exposed film is fed into the machine, a film sensor 18 detects the film for switching from the standby temperature to the operating temperature.

Where either the operating temperature or the developing period is maintained constant depending on the mode of operation, of course, only one table such as Table 3 or Table 4 needs to be used to obtain temperature difference data.

It will be understood that tables like Table 3 and Table 4 may be used also where neither the operating temperature nor the developing period is constant. However, this will be less effective in saving energy than the use of Table 1.

In the described embodiment, the temperature difference data are stored in the data memory and are read out in response to the set operating temperature and the developing period. This is not limitative and actually the relationship between operating temperature and time obtained from FIG. 2 may be approximated to determine an appropriate temperature difference.

Figure 5:
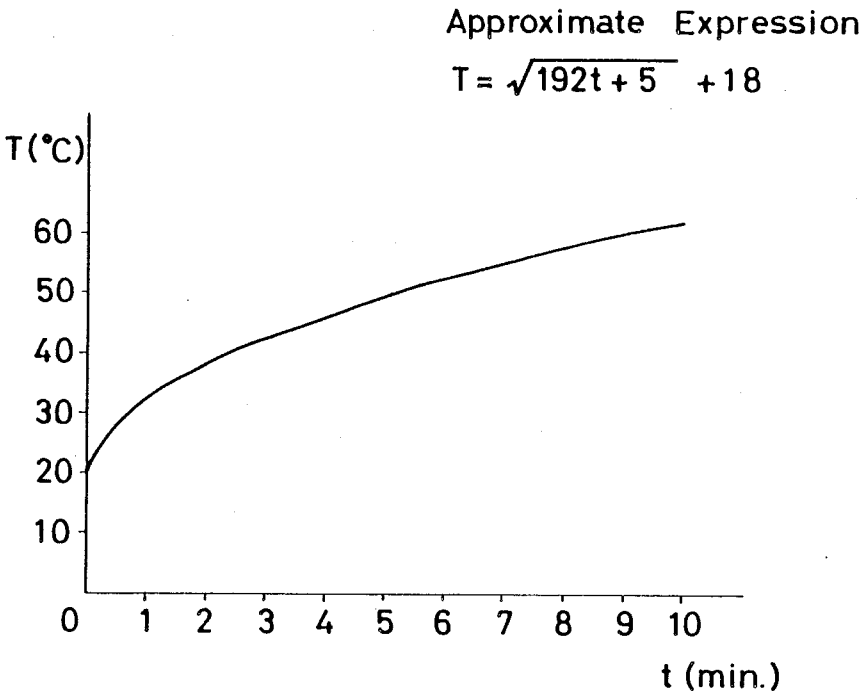
FIg. 5 is a graph obtained from an approximate expression of the graph shown in FIG. 2.

An approximate expression where the curve in FIG. 2 is a curve of ½ degree equation, for example, is as follows (a graph employing this expression being shown in FIG. 5):

$$T = \sqrt{192t + 5 + 18},$$

where t is time in minutes, and T is the operating temperature in centigrade.

The approximate expression has an inclination, derived from the above equation, as follows:

$$\frac{\Delta T}{\Delta t} = \frac{96}{T\text{-}18} \; (T \geqq 20)$$

This inclination $$\frac{\Delta T}{\Delta t}$$

corresponds to the temperature increase rate (°C./min.) for the operating temperature T° C. Therefore, if the operating temperature is 45° C., for example, the temperature increase rate will be $$\frac{\Delta T}{\Delta t} = \frac{96}{45\text{-}18} = 3.56 \; (°C./min.)$$

Thus, the foregoing temperature difference data may be calculated by using this temperature increase rate. The temperature increase rate derived from this formula concerns a given operating temperature at a given point of time. Therefore an operation may be carried out to average temperature increase rates over a selected range.

While the temperature difference data are used throughout the described embodiment, standby temperatures may be stored directly in the memory for use. For example, Table 1 may be replaced by Table 5 below.

TABLE 5

| Operating Temp. (°C.) | Developing to Developing 20–29 | 30–39 | 40 & above |
|---|---|---|---|
| 55° C. | 54° C. | 53° C. | 51° C. |
| 54 | 53 | 51 | 49 |
| 53 | 52 | 50 | 48 |
| 52 | 51 | 49 | 47 |
| 51 | 50 | 48 | 46 |
| . | . | . | . |
| . | . | . | . |
| . | . | . | . |

It is desirable to set the standby temperature at relatively high levels during winter when the room temperature is low. Thus, in a further embodiment, a temperature sensor may be provided for detecting the temperature of a room where the film processing apparatus is installed. It is considered effective to make further adjustments of the standby temperature according to the levels of the detected room temperature.

Preferred embodiments of the invention have been described as applied to an automatic film developing machine but this should not be understood as limitative. The invention is applicable generally to all photosensitive material processing apparatuses for processing photosensitive printing plates, photographic paper and the like with processing solutions and for thereafter heating and drying these materials. It is preferred, therefore, that the present invention be limited not by the specific disclosure herein, but only by the appended claims.

We claim:

1. A method of controlling the temperature of a drying section to reduce the total energy consumption of said drying section, said method comprising the steps of:

inputting a current operating mode of a machine for processing photosensitive material;

drying photosensitive material in a drying section of said machine at an operating temperature; and in response to said inputting step, maintaining said drying section at a standby temperature, said standby temperature being functionally related to (a) said current operating mode of said machine and (b) the ability of said drying section to increase its temperature from said standby temperature to said operating temperature.

2. The method of claim 1, wherein said step of inputting a current operating mode of said machine includes inputting said operating temperature of said drying section.

3. The method of claim 1, wherein said step of inputting a current operating mode of said machine includes inputting the period of time required for photosensitive material to pass through a developing section of said machine.

4. The method of claim 1, wherein said step of inputting a current operating mode of said machine includes (a) inputting said operating temperature of said drying section and (b) inputting the period of time required for said photosensitive material to pass through a developing section of said machine.

5. The method of claim 1, and further comprising the step of providing data concerning temperature differences between various operating temperatures of said drying section and corresponding standby temperatures.

6. The method of claim 5, wherein said data are obtained by performing preliminary experiments on said drying section, said preliminary experiments including the steps of setting and operating the temperature of said drying section at increasingly higher levels; calculating the respective rates of temperature increase within said drying section between each of said levels; and multiplying each of said temperature increase rates by the period of time necessary to feed said photosensitive material through said processing machine under different operating modes of said processing machine.

7. The method of claim 5, wherein said operating temperature is controlled at each of said levels by alternately switching a heater on and off.

8. The method of claim 5, wherein said drying section is allowed to operate for a period of time before the temperature of said drying section is set at a higher level.

9. A system for controlling the temperature of a drying section to reduce the total energy consumption of said drying section, said system comprising:

means for inputting a current operating mode of a machine for processing photosensitive material;

means for drying photosensitive material in a drying section of said machine at an operating temperature; and means for maintaining said drying section at a standby temperature, said maintaining means being responsive to said inputting means, said standby temperature being functionally related to (a) said current operating mode of said machine and (b) the ability of said drying section to increase its temperature from said standby temperature to said operating temperature.

10. The system of claim 9, wherein said means for inputting a current operating mode includes means for inputting said operating temperature of said drying section.

11. The machine of claim 9, wherein said means for inputting a current operating mode includes means for inputting the period of time required for photosensitive material to pass through a developing section of said machine.

12. The system of claim 9, wherein said means for inputting a current operating mode includes (a) means for inputting said operating temperature of said drying section and (b) means for inputting the period of time required for photosensitive material to pass through a developing section of said machine.

13. A method of controlling a standby temperature of a drying section of a processing machine wherein said drying section is maintained at said standby temperature when said processing machine does not process a photosensitive material and is maintained at an operating temperature during processing of said photosensitive material, and wherein said standby temperature is maintained lower than said operating temperature to reduce the total energy consumption of said drying section, the method comprising the steps of:

(a) determining ranges of operating temperatures of said drying section and time periods required for said photosensitive material to pass through a developing section of said machine;

(b) selecting and inputting an operating temperature and a time period within said ranges determined in step (a);

(c) obtaining, prior to executing said step (b), control data for determining various standby temperatures, said control data including data elements corresponding to said operating temperatures and said time periods; and (d) determining said standby temperature on the basis of said data elements in accordance with said operating temperature and said time period inputted in step (b) and maintaining the temperature of said drying section on the basis of said data elements.

14. The method of claim 13, wherein said obtaining step (c) includes:

(c-1) performing preliminary experiments on said drying section including setting and operating the temperature of said drying section at increasingly higher levels;

(c-2) calculating respective temperature increase rates within said drying section between each of said levels; and (c-3) multiplying each of said temperature increase rates by the time period necessary to convey photosensitive material through said developing section.

15. The method of claim 14, wherein said operating temperature is controlled at each of said levels by alternately switching a heater on and off.

16. The method of claim 15, wherein said drying section is allowed to operate for a time period before the temperature of said drying section is increased to a higher level.

17. The method of claim 13, wherein said obtaining step (c) includes performing preliminary experiments on said drying section including continuously energizing a heater and deriving a temperature increase rate between predetermined levels of said operating temperatures.

18. The method of claim 13, wherein said data elements comprise values of differences of said operating temperatures from said standby temperatures.

19. The method of claim 13, wherein said data elements are said standby temperatures.

20. A method of controlling a standby temperature of a drying section of a processing machine wherein said drying section is maintained at said standby temperature when said processing machine does not process a photosensitive material and is maintained at an operating temperature during processing of said photosensitive material, and wherein said standby temperature is maintained lower than said operating temperature to reduce the total energy consumption of said drying section, the method comprising the steps of:

(a) determining ranges of operating temperatures of said drying section and time periods required for said photosensitive material to pass through a developing section of said machine;

(b) selecting and inputting an operating temperature or a time period within said ranges determined in step (a);

(c) obtaining, prior to executing said step (b), control data for determining various standby temperatures, said control data including data elements corresponding to said operating temperatures and said time periods; and (d) determining said standby temperature on the basis of said data elements in accordance with said operating temperature or said time period inputted in step (b) and maintaining the temperature of said drying section on the basis of said data elements.

21. The method of claim 20, wherein said obtaining step (c) includes:

(c-1) performing preliminary experiments on said drying section including setting and operating the temperature of said drying section at increasingly higher levels;

(c-2) calculating respective temperature increase rates within said drying section between each of said levels; and (c-3) multiplying each of said temperature increase rates by the time period necessary to convey photosensitive material through said developing section.

22. The method of claim 21, wherein said operating temperature is controlled at each of said levels by alternately switching a heater on and off.

23. The method of claim 22, wherein said drying section is allowed to operate for a time period before the temperature of said drying section is increased to a higher level.

24. The method of claim 20, wherein said obtaining step (c) includes performing preliminary experiments on said drying section including continuously energizing a heater and deriving a temperature increase rate between predetermined levels of said operating temperatures.

25. The method of claim 20, wherein said data elements comprise values of differences of said operating temperatures from said standby temperatures.

26. The method of claim 20, wherein said data elements are said standby temperatures.

* * * * *